US005359778A

United States Patent [19]

Seber et al.

[11] Patent Number: 5,359,778

[45] Date of Patent: Nov. 1, 1994

[54] KNIFE WITH CUTTING HOOK

[75] Inventors: Brett P. Seber, Escondido; Randolph J. Morton, Lakeside; William H. Keys, El Cajon; Patrick W. Kraft; William R. Bates, Jr., both of Santee; Marlow D. Hussey, Alpine, all of Calif.

[73] Assignee: Buck Knives, Inc., El Cajon, Calif.

[21] Appl. No.: 929,731

[22] Filed: Aug. 13, 1992

[51] Int. Cl.[5] ..... B26B 29/00

[52] U.S. Cl. ..... 30/294

[58] Field of Search ..... 30/280, 289, 294, 314

[56] References Cited

U.S. PATENT DOCUMENTS

| | | | |
|---|---|---|---|
| 3,445,931 | 5/1969 | Knudson | 30/294 |
| 3,605,268 | 9/1971 | Cassell, Sr. | 30/294 |
| 3,670,733 | 6/1972 | Carlisle | 30/294 |
| 3,673,687 | 7/1972 | Phillips et al. | 30/294 |
| 4,134,206 | 1/1979 | Beermann | 30/294 |

FOREIGN PATENT DOCUMENTS

| | | | |
|---|---|---|---|
| 1225073 | 9/1966 | Germany | 30/294 |

*Primary Examiner*—Richard K. Seidel
*Assistant Examiner*—Paul M. Heyrana, Sr.
*Attorney, Agent, or Firm*—Gregory Garmong

[57] ABSTRACT

A knife comprises a handle, a blade having a blade back, and a hook integral with the blade. The hook includes a hook body extending laterally outwardly from the blade back side of the knife blade. A finger of substantially constant diameter and with no sharp edges extends rearwardly toward the handle from the outward margin of the hook body. The finger preferably has a length of at least about 0.2 inches and is displaced laterally outwardly from the adjacent portion of the knife back by a distance of at least about ¼ inch. The finger is oriented at an angle to the handle of at least about 5 degrees. A slot defined by the hook body, the finger, and a portion of the blade back includes a straight cutting edge oriented at 90 degrees to the finger, and centering ramps that guide the material being cut into the cutting edge.

13 Claims, 2 Drawing Sheets

KNIFE WITH CUTTING HOOK

BACKGROUND OF THE INVENTION

This invention relates to knives, and, more particularly, to a knife with a cutting hook of the gut hook and skinning type.

An animal harvested in the field by a hunter must be quickly skinned and eviscerated. Too long a delay may adversely affect the quality of the meat. Thus, it is common practice for hunters to skin and clean the animal at the site of the kill.

The meat of the animal is covered by the hide and hair, which must be removed by skinning. A thin membrane lies between the hide and the meat. The viscera of the animal are enclosed within another membrane termed the "visceral linings", which also must be separated and removed during the cleaning operation. A clean removal of the viscera without puncturing the visceral linings is critical, as a puncturing of the visceral linings leads quickly to contamination of the meat.

To skin and clean the animal, the hunter usually hangs the animal by its legs. (Less preferably, the skinning and cleaning can be accomplished with the animal lying on the ground.) The hunter cuts through the layer of hide and hair so that it can be peeled away from the meat. After the hide and hair are removed, another cut is made through the layer of meat to permit it to be separated from the visceral lining containing the viscera.

It has long been common practice for hunters to use a conventional knife to perform the primary skinning and cleaning operations. To guide the knife, break the suction between the layers during the cutting operation, and prevent the knife from penetrating into the visceral lining, the hunter typically places the index and middle fingers of the guiding hand on either side, and slightly forward, of the point of the knife blade. The point of the knife blade is thereby covered by the hunter's fingers placed on either side of the blade to guide the knife, prevent the point from penetrating the visceral lining, and break the vacuum that would otherwise prevent the separation of the layers. The knife, with the hunter's fingers in place on either side of the blade, is pushed through the layers to be cut in the required pattern.

More recently, a special form of knife termed a "gut hook" or "skinning gut hook" has been developed. The gut hook includes a hook-shaped, backwardly facing, sharpened slot on the back side of the knife blade. To accomplish the cutting operation in the recommended manner, the hook is pushed through the layer to be cut and drawn toward the body of the hunter so that the hide or meat is cut by the sharpened interior of the slot.

In practice, the existing gut hooks fall short of achieving the desired function. The cutting operation requires an excessive amount of force. For many animal types, the hide tends to bunch in the sharpened slot, much as thick cloth tends to bunch when pushed into a fixed cutting slot. The cutting slot becomes jammed with the bunched hide, completely preventing further cutting. The existing gut hooks are not convenient to use and are not readily guided between the intended layers to be separated.

There is a need for an improved approach for a knife that can be used to skin animals in the field and for other functions similar in the respect that they require cutting of thick materials by a fixed cutting surface. The present invention fulfills this need, and further provides related advantages.

SUMMARY OF THE INVENTION

The present invention provides a knife with a fixed edge for cutting thick, tough materials such as the hides of animals. The knife is particularly useful in skinning and gutting of animals, and can also be used for cutting through artificial materials such as cardboard. The knife is operable for skinning and gutting animals having a wide range of types of fur and hide with minimal force required and without Jamming of the hide against the fixed cutting edge. Significantly, the knife can be used to cut hides having a wide range of thicknesses of the hide and fur. The design prevents punctures of the visceral lining, and damage to the meat. The knife is also quite easy and convenient to use for the skinner.

In accordance with the invention, a knife comprises a handle, a blade having a blade back, and a hook integral with the blade. The hook includes a hook body extending laterally outwardly from the blade back side of the knife blade, with the outwardly extending margin of the hook body defining a hook back. A finger extends rearwardly toward the handle from the outward margin of the hook body, the finger having a finger back forming a continuous surface with the hook back. The hook body, the finger, and a portion of the blade back define a hook slot having a slot outer side, a slot inner side, and a slot bottom. An outer ramp is formed in the transition from the slot outer side to the slot bottom, and a cutting edge is formed at the slot bottom.

The hook body displaces the finger laterally outwardly from the knife back and positions the finger at an angle to the handle of the knife. The finger is preferably displaced outwardly from the knife back by a distance of at least about $\frac{1}{4}$ inch, preferably about 0.28–0.34 inches, and most preferably about 0.303 inches, and has an angle of at least about 5 degrees, preferably about 13.5 degrees, outwardly from the axis of the handle. The outward displacement of the finger defines the slot as an outwardly protruding structure, rather than a cutout from the interior of the knife blade as in interior of the knife blade to a protruding position permits the material being cut to move into the slot more easily. The angular rotation of the finger from the axis of the handle permits the finger to be inserted easily into the material to be cut. Moreover, a space between the handle and the material being cut is left available for the hand of the user of the knife.

The finger performs the important function of guiding the knife hook into the material, or, alternatively stated, guiding the material being cut into the slot. The finger breaks the suction or vacuum that would otherwise persist between the layers being cut and separated, allowing the layers to be better defined and separated. The finger also anchors the knife in the material being cut, so that the reactive force of the material as it is compressed into the slot and parted cannot push the knife out of the material. In this use, the finger reaches inside the material being cut, and is the element of the structure of the knife that is closest to sensitive, breakable features of the material being cut such as the visceral lining of an animal. The finger therefore is made smooth along its sides, preferably by chamfering, and at the end inserted into the material.

The finger back and the hook back form a continuous surface termed a "tabletop" which slides along the layer not being cut (the visceral linings during gutting) during the skinning and/or gutting operations. The tabletop surface, in cooperation with the position and angular orientation of the finger, guides the hook along the intended path during the skinning and cleaning operations.

The slot accomplishes the actual cutting of the material fed into the slot, and its structure is a key to the cutting operation. As the material feeds into the slot, it is turned upwardly as it passes over the outer ramp between the finger and the cutting edge. The material rises along the outer ramp and is placed in increasing local tension. The combination of the Increasing angle and increased tension cause the material to roll back slightly as it reaches the cutting edge. The underside of the material is thereby presented to the cutting edge for slitting.

The cutting edge is preferably a sharpened, straight edge oriented at about 90 degrees to the hook back and the finger back. In the preferred embodiment, the cutting .edge is at least about 0.10 inches, most preferably about 0.125 inches, long and is oriented at 90 degrees to the hook back. Optionally, an inner ramp between the blade back and the cutting edge aids in centering the material and feeding it into the cutting edge, particularly where the material is quite thick.

Extensive testing has shown that a design and size of the gut hook knife is highly effective in skinning and gutting a variety of types of animal hides. The knife is compact and also has a conventional sharpened blade for other uses. Other features and advantages of the invention will be apparent from the following detailed description of the preferred embodiment, taken in conjunction with the accompanying drawings, which illustrate, by way of example, the principles of the invention.

DETAILED DESCRIPTION OF THE INVENTION

Figure 1:
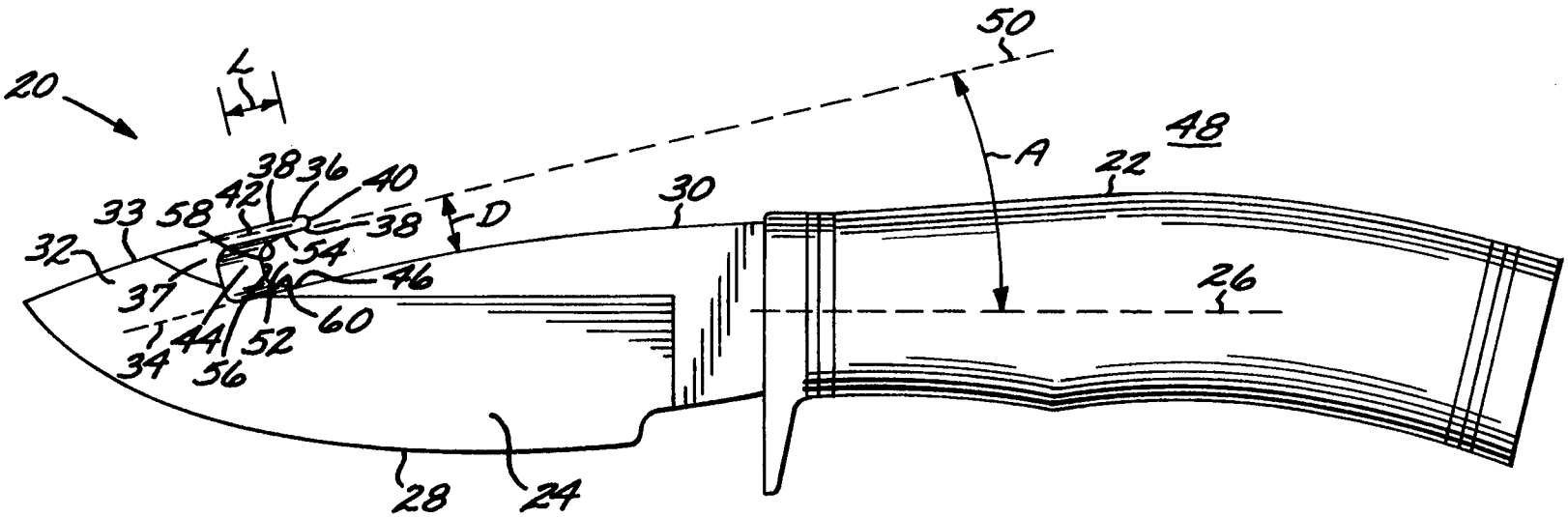
FIG. 1 is a side elevational view of a knife in accordance with the invention.

FIG. 1 depicts a knife 20 utilizing the skinning gut hook of the invention. The knife 20 has a handle 22 and a blade 24 fixed to the handle 22. In this case, the handle 22 and the blade 24 are rigidly fixed together, but they could also be of the folding pocketknife type. For reference purposes, the handle 22 may be described as having a handle axis 26 defining the orientation of the handle 22 at the point where it is Joined to the blade 24. The blade 24 is described as having a sharpened front side 28 and a back 30. Both the handle 22 and the blade 24 may otherwise be curved and provided with other features commonly found in knives and not inconsistent with the hook structure to be described subsequently. Thus, for example, the blade back SO and the blade front side 28 may be slightly curved toward each other, as depicted in FIG. 1.

Integrally attached to the blade 24 along its back side and remote from the handle 22 is a hook body 32. The hook body 32 lies in the plane of the blade 24 and extends laterally outwardly from the blade 24 in a direction generally (although not necessarily exactly) perpendicular to the blade back 30. The hook body 32 terminates in a hook back 33 remote from the body of the blade 24. The hook back 33 is a surface that is slightly curved to lie parallel to an extrapolation 34 of the blade back 30, but is otherwise generally flat.

A finger 36 is integral with the hook body 32 and extends rearwardly from an outer margin 37 of the hook body 32 toward the handle 22. The hook body 32, the blade 24, and the finger 36 are conveniently fabricated as a single unit, but are here discussed as separate sections of that unit for convenience. Because it is Joined to the hook body 32 at its outward margin, the finger 36 is laterally displaced from the knife back 30. The finger 36 is preferably a metal piece of generally uniform, though slightly tapered, section. Its sides 38 and tip 40 are chamfered and smoothed, without sharp edges that could inadvertently tear the hide, meat, visceral lining, or other membrane when the finger 36 is used for skinning or gutting.

The finger 36 is oriented so that its finger back 42 forms a continuous smooth surface with the hook back 33, sometimes collectively termed herein the "table top". The hook body 32 and the blade 24 are configured such that the finger 42 is oriented with respect to the handle axis 26 with an offset angle A. The table top acts as a guide surface that rests against the inner layer of the body of the animal that is being skinned or gutted. For the gutting operation, the table top slides over the visceral lining. The table top acts much like the fence of a table saw, to guide the material being cut through the cutting implement, at a fixed spacing. The combination of the table top and the angular orientation A of the finger 36 aid in firmly positioning the knife during skinning or cleaning. The combination of the lateral displacement of the finger 36 and the offset angle A create a space 48 between an extrapolation 50 of the finger 36 and the handle 22 that provides the room for the user of the knife 20 to grasp the handle 22 and use the knife 20 during skinning and gutting.

Figure 2:
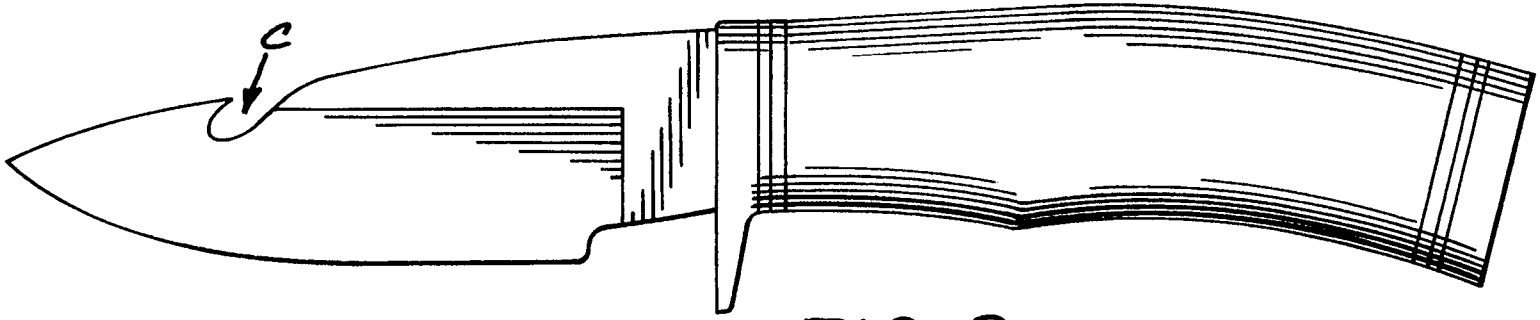
FIG. 2 is a side elevational view of a prior gut hook configuration.

The finger 36, a rearwardly facing edge 44 of the hook body 32, and a portion 45 of the blade back 30 together define a slot 52. Because the hook body 32 laterally separates the finger 36 from the bladeback 30, the slot 52 is raised above the blade back 30. This configuration is distinct from that of gut hooks previously known in the art, and illustrated generally in FIG. 2. Here, there is a cutout C in the blade of the knife, extending below the back of the blade.

One side of the slot 52 is formed by a portion 54 of the finger 36 that lies generally parallel to the portion 45 of the blade back 30 that forms the other side of the slot 52. The bottom of the slot 52, formed by the rear facing edge 44 of the hook body 32, is sharpened to form a cutting edge 56. The cutting edge 56 is preferably straight and oriented at an angle of about 90 degrees to the hook back 33, the finger back 42, and the extrapolation 34 of the blade back 30.

Material fed into the slot 52 for cutting is raised into the cutting edge 56 by an outer ramp 58 that angles from the portion 54 of the finger 36 to the cutting edge 56. The raising of the material by the outer ramp 58 has two important beneficial effects on the cutting of the material. First, the material is curled upwardly so that its under side actually first contacts the cutting edge 56. A piece of animal hide (with fur or half on the outside) can be cut more easily from the under side than from the upper side. When the cutting occurs from the upper side, the blade must first pass through the half and fur, which may be matted and are in any event difficult to cut as they are compressed downwardly. When the cutting occurs from the under side, as here, the hide is first cut and then the cutting edge can easily pass upwardly through the hair and fur by pushing it aside outwardly rather than compressing it inwardly. Thus, in the present approach the hair and fur are not cut, as in the prior approach to gut hooks, but pushed aside. The cutting of hair and fur tends to dull a knife quickly. The present approach therefore has the further benefit that the cutting edge tends to stay sharp longer, because it does not cut the hair or fur during skinning.

Second, the raising of the piece of material as it passes along the outer ramp 58 places the piece of material in gradually increasing tension. The increasing tension permits the material to be cut more easily than if the material were slack, just as a piece of cloth can be cut more easily if it is laterally tensioned.

There is also desirably provided an inner ramp 60 that angles from the portion 46 of the blade back 30 that forms the inner side of the slot 52 to the cutting edge 56. The inner ramp 60 aids in guiding thicker pieces of material into the cutting edge 56, but is not needed where thin pieces of material are cut.

In a preferred version of the knife 20 having the configuration shown in FIG. 1, the finger 36 is generally parallel to the portion 46 of the blade back 30, and is laterally displaced from the portion 46 by a distance D that is at least about ¼ inch, is more preferably about 0.28–0.34 inches, and is most preferably about 0.303 inches. If the distance D is less than about ¼ inch, the knife becomes difficult to use for animals with thicker hides. A smaller distance D might be operable for small animals, but this would force the hunter to carry a range of knife sizes for different animals. The preferred knife 20 is suitable for a wide range of types of animals. The distance D may be larger than indicated, but if it is too great, the knife becomes unwieldy and awkward to use for general purposes but still may be operable. The angle A of the finger 36 relative to the handle axis 26 is preferably at least about 5 degrees, and is most preferably about 13.5 degrees. If the angle A is less, the space 48 is insufficient for most users. As the angle A becomes very large, the pulling force exerted on the handle 22 during use of the knife, when resolved into the component parallel to the finger 36, is typically insufficient for skinning and gutting operations. The preferred displacement D and the preferred angle A were determined by comparison field testing a number of similar knives of the present design, except that D and A were varied. The preferred values were chosen as providing the greatest effectiveness and convenience.

The length L of the finger 36 must be at least about 0.2 inches, and is preferably about 0.3 inches. The finger 36 has several important functions when the knife 20 is used. It guides the knife 20 as it is pulled along the cutting track, and it also holds the knife 20 in the material since it extends into the uncut region of the material. If the length L is less than the indicated minimum, then the finger 36, and thence the knife 20, tends to pop out of the inserted cutting position when the knife 20 is used. This is an important consideration, since a key advantage of the present knife 20 is its ability to remain in the correct cutting position when in use, so that the user need not concentrate his attention on maintaining the knife 20 within the material being cut. Instead, the user can concentrate his attention on guiding the knife along the desired cutting path.

The cutting edge 56 is preferably straight and oriented at about 90 degrees to the hook back 33. The length of the straight edge 56 is desirably at least about 0.10 inches, and preferably is about 0.125 inches long, in order to accomplish the cutting of most materials smoothly. The length may be less, or for some materials the cutting edge 56 may even be slightly curved, preferably concavely. In general, however, the most smooth and efficient cutting is achieved when the cutting edge 56 is straight.

A total of about 50 knives utilizing various gut hook designs were fabricated and tested in the field to establish their operability. The knives were tested in the skinning and gutting of sheep, deer, boar, bear, and elk. The tests were conducted in five groups. A first group of knives was prepared and tested, and then promising designs were further developed in the next group. This process was repeated until the preferred knife of FIG. 1 was developed. In these knife designs, the principal variables tested were the length L of the finger, the separation D of the finger from the blade back and whether the slot protrudes above the blade (FIG. 1) or is a cutout within the blade (FIG. 2), the angle A of the finger relative to the handle axis, the configuration of the finger, and the configuration of the cutting edge. Other considerations such as the compactness of the knife and its appearance were qualitatively evaluated.

Figure 3:
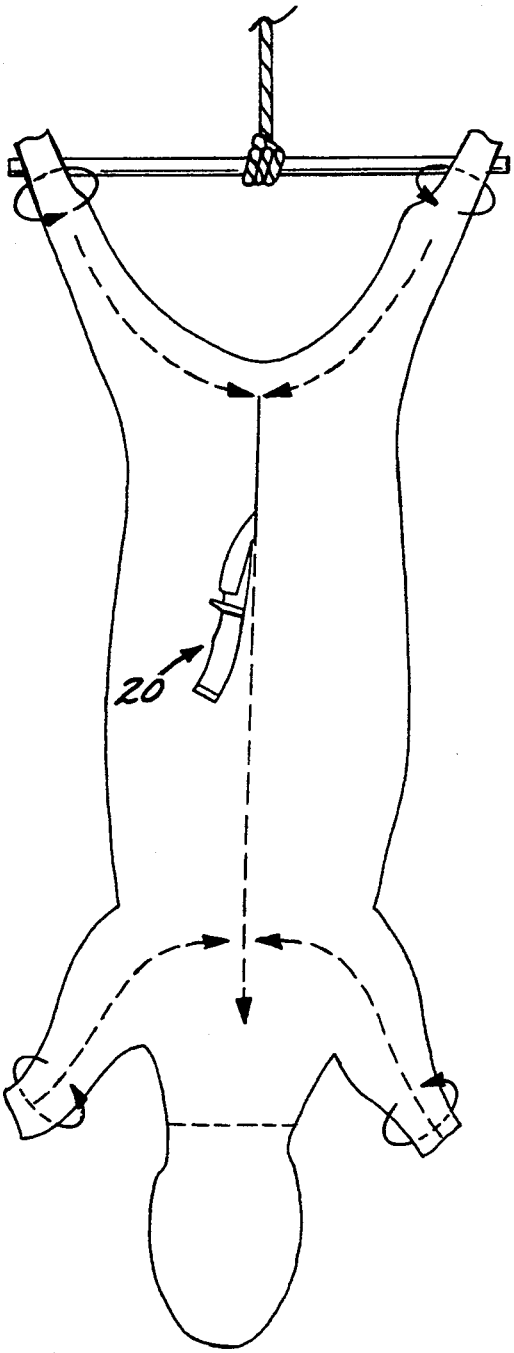
FIG. 3 is a perspective view of the use of the knife in skinning an animal.

FIG. 3 depicts a typical skinning procedure. The animal is hung from its rear legs, and circular cuts are made at the extremities to permit the hide and fur to be peeled from the meat. The knife 20 is inserted in the manner shown and drawn downwardly. The effectiveness of the knife is judged from the force required to draw the knife through the hide, the absence of a gathering and bunching of the hide at the cutting edge that eventually clogs the slot and prevents further cutting, and the ability of the user to guide the knife in the desired direction without it popping out of the cut.

Figure 4:
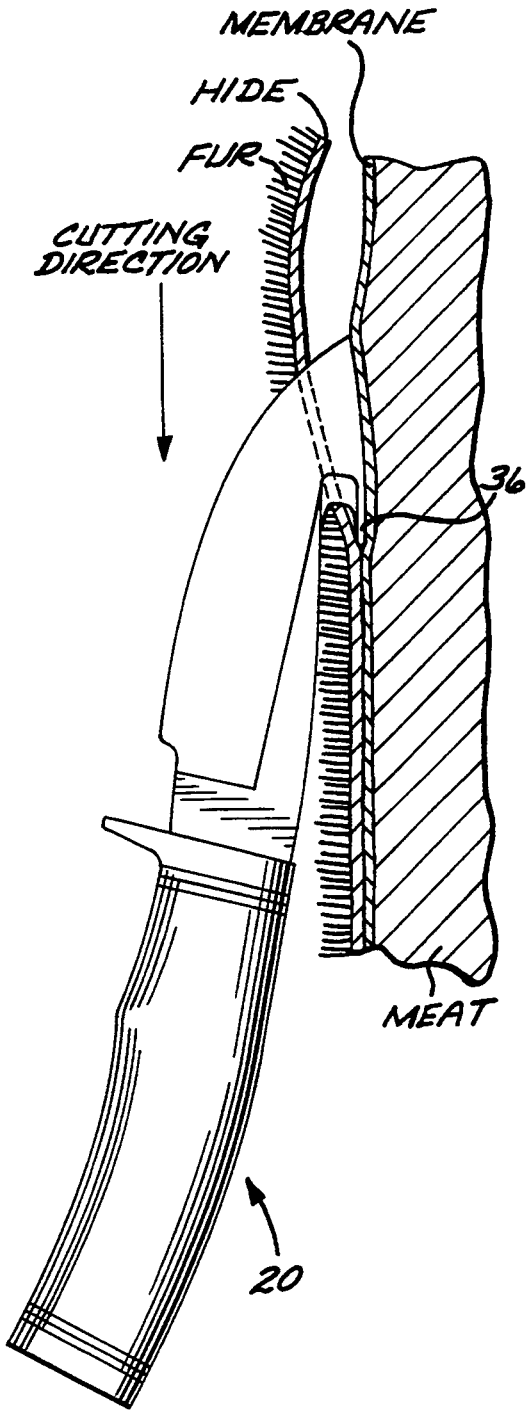
FIG. 4 is an enlarged elevational view of the knife of the invention as used in skinning.

FIG. 4 is a side view of the knife cutting through the hide in the skinning operation and separating the hide from the membrane and underlying meat. The elongated, relatively small diameter finger 36 holds the knife 20 in the cut, even though the springiness of the fur and hide tend to force the knife out of the cut. The rounded structure of the finger prevents tearing of the hide or the meat, or, in the case of the subsequent gutting operation, the visceral linings. The latter is critical, because puncturing the visceral linings would lead to immediate contamination of the meat. The hook back 33 and the finger back 42 (acting together as the table top) and the angle A define the most comfortable orientation for the knife.

The cooperation of the hook back 33, the finger back 42, and the finger 36 cause the knife to assume the desired angle for feeding of the hide into the slot 52, without the knife popping out of the cut. As the finger penetrates between the layers of hide and meat, it serves to separate the hide from the meat and to break the vacuum and suction that would otherwise tend to hold the hide to the membrane and underlying meat. With further penetration, the outer ramp 58 deflects the hide upwardly so that it curls back slightly to expose the underside of the hide to the cutting edge 56. Testing of several configurations of cutting edge, including various curved edges, straight edges of various lengths, and straight edges of various inclinations established the preferred design and parameters discussed previously. Most surprisingly, the combination of the outer ramp and straight, 90 degree cutting edge were found to produce superior cutting performance over a range of types of hides, as compared with various curved cutting edges and even serrated cutting edges.

The knife of the present invention has applicability beyond skinning and gutting, such as in the opening of cardboard boxes. For example, in grocery stores items in puncturable, flexible containers (e.g., sacks of rice, boxes of breakfast cereal) are received packaged in cardboard boxes. The boxes are opened with knives, sometimes with difficulty and sometimes causing punctures of the containers therein. The hook of the knife of the present invention has been found highly effective in opening such cardboard boxes smoothly and uniformly, and without damaging the interior containers due to the careful design of the rounded finger.

Although a particular embodiment of the invention has been described in detail for purposes of illustration, various modifications may be made without departing from the spirit and scope of the invention. Accordingly, the invention is not to be limited except as by the appended claims.

What is claimed is:

1. A knife, comprising:
a handle;
a blade having a blade back; and
a hook integral with the blade and including
a hook body extending laterally outwardly from the blade back side of the knife blade, the outwardly extending margin of the hook body defining a hook back,
a finger extending rearwardly toward the handle from the outward margin of the hook body, the finger having a finger back forming a continuous surface with the hook back,
the hook body, the finger, and a portion of the blade back defining a hook slot having a slot outer side, a slot inner side, and a slot bottom that is substantially straight and oriented at an angle of about 90 degrees to the hook back,
an outer ramp from the slot outer side to a first end of the slot bottom,
an inner ramp from the slot inner side to a second end of the slot bottom, and
a cutting edge at the slot bottom.

2. The knife of claim 1, wherein the finger is substantially parallel to the laterally adjacent portion of the blade back.

3. The knife of claim 1, wherein the finger is laterally separated from the adjacent portion of the blade back by a distance of from about 0.28 to about 0.34 inches.

4. The knife of claim 1, wherein the hook back forms an angle of at least about 5 degrees relative to the handle.

5. The knife of claim 1, wherein the finger has a length of at least about 0.2 inches.

6. The knife of claim 1, wherein the surface of the finger has no sharp edges.

7. The knife of claim 1, wherein the knife blade has a sharpened edge oppositely disposed from the blade back.

8. The knife of claim 1, wherein the hook further includes
an inner ramp in the region where the slot inner side meets the slot bottom.

9. A knife, comprising:
a handle;
a blade having a blade back; and
hook means integral with the blade for controllably parting a material, comprising:
finger means for guiding the movement of the knife and preventing it from disengaging from the material, the finger means including a finger extending parallel to the adjacent portion of the blade back and having a length of at least about 0.2 inches,
finger support means for supporting the finger at a location laterally outwardly displaced from the adjacent portion of the blade back and at an angle to the handle of more than about 5 degrees, the finger, finger support means, and adjacent portion of the blade back together defining a slot,
a cutting edge within the slot, and
means within the slot for guiding the material to the cutting edge; wherein the cutting edge within the slot is substantially straight and oriented at an angle of about 90 degrees to the adjacent portion of the blade back.

10. The knife of claim 9, wherein the finger is laterally separated outwardly from the adjacent portion of the blade back by a distance of at least about ¼ inch.

11. The knife of claim 9, wherein the surface of the finger has no sharp edges.

12. The knife of claim 9, wherein the means for guiding includes
a pair of ramps, one adjacent each end of the cutting edge.

13. A knife, comprising:
a handle;
a blade having a blade back; and
a hook integral with the blade and including
a hook body extending laterally outwardly from the blade back side of the knife blade, the outwardly extending margin of the hook body defining a hook back,
a finger with no sharp edges, the finger extending rearwardly toward the handle from the outward margin of the hook body, the finger having a length of about O.3 inches and being displaced laterally outwardly from the adjacent portion of the blade back by a distance of from about 0.28 to about 0.34 inches, the finger having a finger back forming a continuous surface with the hook back, the hook back and finger back being oriented at an angle to the handle of about 13.5 degrees, the hook body, the finger, and a portion of the blade back defining a hook slot having a slot outer side, a slot inner side, and a slot bottom,
an outer ramp from the slot outer side to the slot bottom,
an inner ramp from the slot inner side to the slot bottom, and
a sharpened cutting edge at the slot bottom, the cutting edge being substantially straight and at least about 0.10 inches long and being oriented at an angle of about 90 degrees to the hook back.

* * * * *